United States Patent [19]

Martina et al.

[11] Patent Number: 4,726,518

[45] Date of Patent: Feb. 23, 1988

[54] STRAW FOR SUCKING BEVERAGES

[76] Inventors: Emanuela Martina, Via Maffucci, 34, 20158 Milano; Maria Ruvolo, Via Riccione, 9, 20156 Milano, both of Italy

[21] Appl. No.: 844,950

[22] Filed: Mar. 27, 1986

[30] Foreign Application Priority Data

Apr. 12, 1985 [IT] Italy ..... 21426/85[U]

[51] Int. Cl.[4] ..... A47G 21/18

[52] U.S. Cl. ..... 239/33; 40/406; 446/202

[58] Field of Search ..... 40/406; D7/42; 446/200, 446/202; 239/33

[56] References Cited

U.S. PATENT DOCUMENTS

| | | | |
|---|---|---|---|
| D. 225,486 | 12/1972 | Bart | D7/42 |
| 2,613,107 | 10/1952 | Hartnett | 239/33 |
| 3,134,680 | 5/1964 | Daline | 239/33 |
| 3,456,344 | 7/1969 | Cornelius | D7/42 X |
| 3,718,282 | 2/1973 | Pizzoferrato | 239/33 |
| 3,780,944 | 12/1973 | Zubalik | 239/33 |
| 4,211,024 | 7/1980 | Nickell | 40/406 |
| 4,379,511 | 4/1983 | del Fabro | 239/33 X |

*Primary Examiner*—Andres Kashnikow

*Attorney, Agent, or Firm*—Browdy and Neimark

[57] ABSTRACT

A straw for sucking beverages which can be utilized to convey advertizing information and messages includes a panel having two opposed flat major faces, a plurality of channels extending between the major faces and having open ends at opposite edges of the panel, and at least one liquid suction region and liquid pick-up region which are formed at the edges and interconnected by at least two of the channels.

8 Claims, 5 Drawing Figures

3
8a
8b
5
5
1
7
1a
1b
8a
4
2

8b
8a
1
3
8a
1a
1
5
5
8b
8a
4

1a
8a
5
5
6
6
6
2

3
1
8a
8b
7
8a
4

STRAW FOR SUCKING BEVERAGES

BACKGROUND OF THE INVENTION

This invention relates to a straw for sucking beverages which has an improved structure.

Straws for sucking beverages have been known for a long time. Originally, they were formed from such naturally occurring materials as vegetal stalks, but are presently mostly made of plastics.

In addition, such straws have already been provided in a variety of designs and configurations, such as paired or twisted together, or including bending sections, or having cross-sectional configurations other than circular, while straws or sets of straws have been proposed which can also serve other purposes besides their typical sucking functions.

As an example of a sucking straw intended to perform several functions, the straw disclosed in U.S. Pat. No. 3,456,344 may be quoted; that straw, in fact, can also be used as a spoon.

Irrespective of their design, none of such prior straws lend themselves for directly and effectively displaying, as an ancillary function of theirs, information and messages, in particular visual advertizing messages.

Actually, the small outer surface of sucking straws does not permit, for example, of direct application of inscriptions or advertizing pictures of an acceptable size. In practice, each straw has been an article inherently unobtrusive and substantially anonymous.

Attempts have been made to remedy this situation at least in part by providing articles which could be used in combination with sucking straws, but these have been basically unsuccessful, bringing about added cost and not negligible manufacturing problems originating from the fact that such articles are to be made separately from the straws.

SUMMARY OF THE INVENTION

It is a primary object of this invention to provide a straw for sucking beverages which is so structured as to enable its direct and satisfactory utilization as a carrier of information and messages, specifically advertising messages.

Another object of the invention is to provide a straw for sucking beverages which can be arranged in a variety of styles, to the point that it may be used as a playing or recreational implement, and even become a collector's item.

A further important object is to provide a straw which is specially efficient and comfortable to use for its typical sucking destination.

A not least object of the invention is to provide a straw which is simple construction-wise, of low cost, and can be easily manufactured on existing plants.

Such objects are substantially achieved by a straw for sucking beverages, characterized in that it is defined by at least one panel having two major opposite and substantially flat faces, a plurality of channels extending between said major faces and having open ends at opposed edges of said panel, and at least one sucking region and pick-up region formed at said opposed edges and being interconnected by at least two of said channels.

BRIEF DESCRIPTION OF THE DRAWINGS

Further features and advantages will become apparent from the following description of some embodiments of the inventive straw, with reference to the accompanying drawings, where.

DESCRIPTION OF THE PREFERRED EMBODIMENTS

Figures 1, 2, 3, 4, 5:
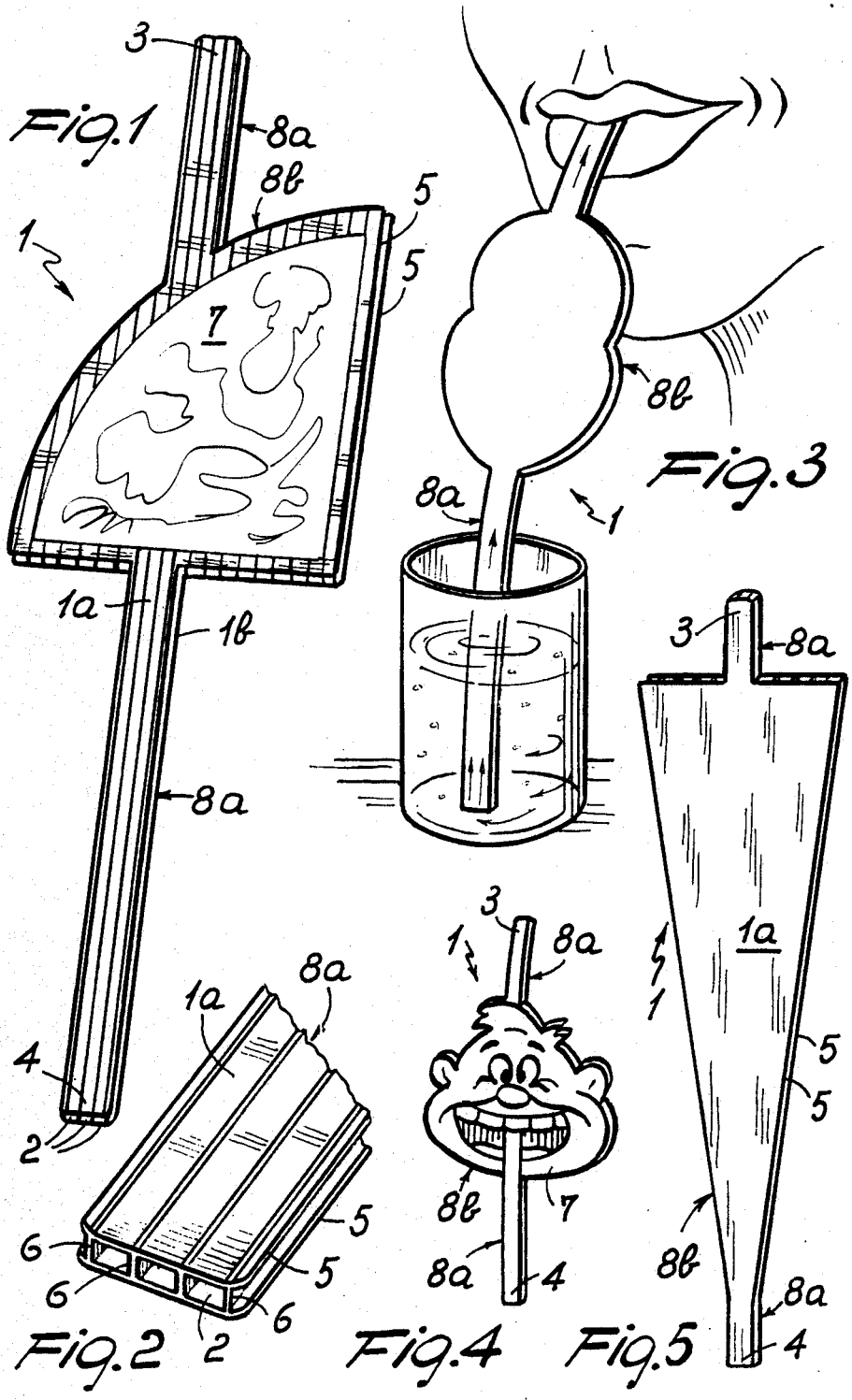
FIG. 1 is a general view of a first embodiment of this straw.
FIG. 2 shows a cross-sectional configuration for the straw of FIG. 1.
FIGS. 3, 4 and 5 show other exemplary embodiments of the straw according to the invention.

With reference to the drawing figures, a straw for sucking beverages, according to this invention, is generally defined by a flattened panel 1 to form two opposed, smooth and flat major faces 1*a*,1*b*. Formed in the thickness of the panel 1 are through-going channels 2 which have open ends at the opposite edges of the panel.

Provision is made, as shown, for the panel 1 to have, along said opposite panel edges whereat said channels 2 open, a liquid sucking region 3 whereto the mouth would be applied and a liquid pick-up region 4 to be dipped into the liquid for sucking. The regions 3 and 4 are interconnected by at least two channels 2, preferably three or more channels 2; throughout the drawing figures, three channels 2 are shown extending from said regions 3,4.

In detail, a preferred structure for the panel 1 is defined by two thin, smooth and flat sheets 5 which extend parallel to each other and form the major faces 1*a*,1*b*, and by a plurality of mutually parallel ribs 6 which are provided between the sheets 5 to form channels 2 lying adjacent to one another and having a substantially parallelogram-shaped cross-section.

It is also envisaged that the panel 1 may be formed from plastics by extrusion molding, e.g. from a clear transparent, translucid, non-toxic plastic material. It this case, the ribs 6 would be formed integrally with the sheets 5. The profile of the panel 1 all along its edges would be obtained, moreover, by the die-cutting process.

The drawing figures show that the panel 1 extends, in its preferred embodiments, on one plane of lay to form two functional parts 8*a* protruding from opposite ends of an auxialiary portion 8*b*.

The functional portions 8*a* extend along one substantially straight line and enclose, as mentioned, plural channels 2 therein.

The auxialiry portion 8*b* is the one which practically determines the panel 1 profile or outline. It is broader, in plan view, than each of the functional portions 8*a*, and may take on a variety of different shapes and outlines. As an example, it may reproduce a figure or imitate an object or provide a more or less broad surface for marking elements 7. Most of the channels 2 extending through the auxiiliary portion 8*b* would not, of course, be used for sucking purposes.

The marking elements 7 may be applied to either one or both faces of the auxiliary portion 8*b*, by any suitable copying and printing technique, or stickers, etc.

Thus, the invention provides a functional straw for sucking beverages, on account of the broad area spanned by the channels 2 and the faculty to vary their number as desired, comfortable to use in that the flat shape of the sucking region creates no inconvenience even where made quite wide, and of low cost because of simple construction. FIG. 2 shows the ribs 6 spaced further apart than the sheets 5.

Above all, the straw of this invention is well adapted to display information and advertising messages of various description directly, may be identified, and be so configured as to readily convert into a collector's or playing item.

We claim:

1. A straw for sucking beverages while showing a message on a panel thereof, comprising:

a plurality of mutually parallel, contiguous channels having open opposite ends and being of different lengths, said channels comprising functional channels forming at said opposite ends one pick-up region and one sucking region and a portion of said panel therebetween, and auxiliary channels forming an enlarged portion of said panel disposed between said pick-up region and said sucking region, said enlarged portion of said panel having exterior surfaces to which marking elements may be attached;

wherein each channel has a substantially quadrilateral section such that substantially flat panel surfaces are formed on opposite sides of said plurality of channels.

2. A straw for sucking beverages, comprising:

a conduit including a plurality of channels disposed side-by-side, said plurality of channels including a first group of channels having opposed, open ends and a first length and a second group of channels having opposed, open ends and lengths different from said first length;

wherein said conduit comprises a first planar element having a peripheral configuration, and a second planar element having a peripheral configuration identical to said peripheral configuration of said first planar element, said first and second planar elements being disposed in facing relationship to one another with said first peripheral configuration aligned with said second peripheral configuration, and means for spacing said first and second planar elements from one another in said facing, aligned disposition.

3. The straw of claim 2, wherein means for spacing said first and second planar elements from one another comprises a plurality of ribs extending betwen said first and second planar elements and maintaining said elements parallel to one another, said ribs and facing surfaces of said first and second planar elements defining therebetween said channels.

4. The straw of claim 3, wherein the dimension across said channels between said ribs is greater than the dimension across said channels between said facing surfaces of said first and second planar elements.

5. The straw of claim 3, wherein the number of said ribs is greater than the number of said channels.

6. The straw of claim 2, wherein said conduit comprises a first region adapted for the application of suction by a user's mouth, a second region adapted for insertion into the beverage to be sucked into the user's mouth, and a third region adapted for displaying markings.

7. The straw of claim 6, wherein said first and second regions are disposed at opposite ends of said conduit.

8. The straw of claim 7, wherein said third region is disposed between said first and second regions.

* * * * *